US011306379B2

(12) United States Patent
Gasqueres et al.

(10) Patent No.: US 11,306,379 B2
(45) Date of Patent: Apr. 19, 2022

(54) THICK PRODUCTS MADE OF 7XXX ALLOY AND MANUFACTURING PROCESS

(75) Inventors: Cedric Gasqueres, Aix en Provence (FR); Jean-Etienne Fournier, Basse-Nendaz (CH)

(73) Assignees: CONSTELLIUM VALAIS SA (AG, LTD), Sierre (CH); CONSTELLIUM ISSOIRE, Issoire (FR)

( * ) Notice: Subject to any disclaimer, the term of this patent is extended or adjusted under 35 U.S.C. 154(b) by 1167 days.

(21) Appl. No.: 13/994,097

(22) PCT Filed: Dec. 6, 2011

(86) PCT No.: PCT/FR2011/000637
§ 371 (c)(1),
(2), (4) Date: Jun. 13, 2013

(87) PCT Pub. No.: WO2012/080592
PCT Pub. Date: Jun. 21, 2012

(65) Prior Publication Data

US 2013/0284322 A1 Oct. 31, 2013

(30) Foreign Application Priority Data

Dec. 14, 2010 (FR) ..... 10/04865

(51) Int. Cl.
*C22F 1/053* (2006.01)
*C22C 21/10* (2006.01)
*C22C 21/00* (2006.01)

(52) U.S. Cl.
CPC ..... *C22F 1/053* (2013.01); *C22C 21/00* (2013.01); *C22C 21/10* (2013.01)

(58) Field of Classification Search
CPC ..... C22C 21/10; C22F 1/053
See application file for complete search history.

(56) References Cited

U.S. PATENT DOCUMENTS 3,322,533 A * 5/1967 Martin ..... C22C 21/10 420/541
8,357,249 B2 1/2013 Cho et al.
(Continued)

FOREIGN PATENT DOCUMENTS

FR 2341661 A1 9/1977
WO 2008003506 A2 1/2008
(Continued)

OTHER PUBLICATIONS

Davis, J.R. "ASM Specialty Handbook: Aluminum and Aluminum Alloys", ASM International, 1993, p. 300-302,317.*
(Continued)

*Primary Examiner* — George Wyszomierski
*Assistant Examiner* — Janell C Morillo
(74) *Attorney, Agent, or Firm* — McBee Moore & Vanik IP, LLC

(57) ABSTRACT

The present invention relates to an aluminum alloy for the manufacture of thick blocks comprising (as a percentage by weight), Zn: 5.3-5.9%, Mg: 0.8-1.8%, Cu: <0.2%, Zr: 0.05 to 0.12%, Ti<0.15%, Mn<0.1%, Cr<0.1%, Si<0.15%, Fe<0.20%, impurities having an individual content of <0.05% each and <0.15% in total, the rest aluminum, The alloy may be used in a process comprising the steps of:

(a) casting a thick block of an alloy according to the invention
(b) solution heat treating said cast block at a temperature of 500 to 560° C. for 10 minutes to 20 hours,
(c) cooling said solution heat treated block to a temperature below 100° C.,
(d) tempering said solution heat treated and cooled block by heating to 120 to 170° C. for 4 to 48 hours, In this process, said block is not subjected to any significant deformation by working between the casting and the tem-
(Continued)

pering. The alloy and the method according to the invention are particularly useful for the manufacture of molds for injection-molding plastics.

12 Claims, 1 Drawing Sheet

(56) References Cited

U.S. PATENT DOCUMENTS

| | | | | |
|---|---|---|---|---|
| 2001/0028861 | A1* | 10/2001 | Fang | C22C 21/10 420/532 |
| 2001/0037844 | A1 | 11/2001 | Bekki et al. | |
| 2005/0238529 | A1* | 10/2005 | Lin | C22C 21/10 420/541 |
| 2008/0056932 | A1* | 3/2008 | Cho | C22C 21/08 420/541 |

FOREIGN PATENT DOCUMENTS

| | | | |
|---|---|---|---|
| WO | 2008005852 | A2 | 1/2008 |
| WO | 2010049445 | A1 | 5/2010 |

OTHER PUBLICATIONS

Davis, J.R. "ASM Specialty Handbook: Aluminum and Aluminum Alloys", ASM International, 1993, p. 28.*

Davis, J.R. "ASM Specialty Handbook: Aluminum and Aluminum Alloys", ASM International, p. 303. (Year: 1993).*

Teal, "International Alloy Designations and Chemical Composition Limits for Wrought Aluminum and Wrought Aluminum Alloys," The Aluminum Association, pp. 1-35, (2004).

Cordier et al..; "Effect of Structure Formation and Heat Treatment on the Strength and Stress Corrosion Craking Susceptibility of Alloy AlZn5.5Mg1.5," Aluminum, vol. 55, No. 12, pp. 777-782, (1979).

International Search Report for Internatioanl Application No. PCT/FR2011/000637 dated Mar. 28, 2012.

* cited by examiner

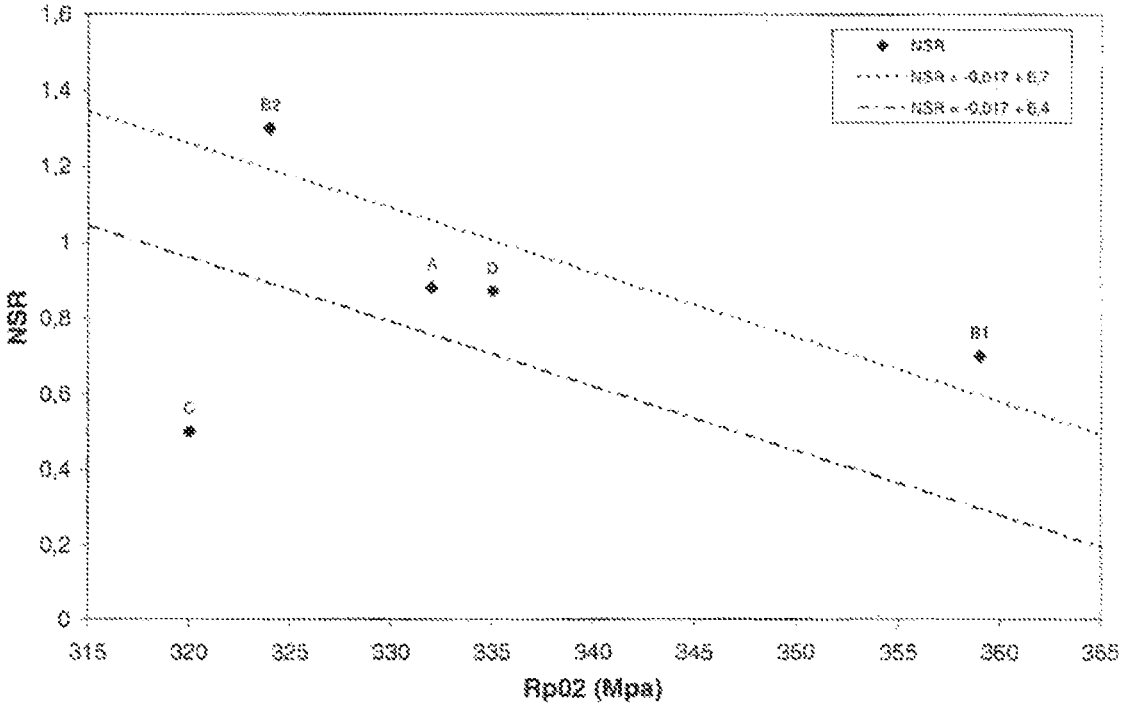
NSR
NSR = -0,017 x 6,7
NSR = -0,017 x 6,4
B2
A
D
B1
C
1,6
1,4
1,2
1
0,8
0,6
0,4
0,2
0
315
320
325
330
335
340
345
350
355
360
365
Rp02 (Mpa)

THICK PRODUCTS MADE OF 7XXX ALLOY AND MANUFACTURING PROCESS

CROSS REFERENCE TO RELATED APPLICATIONS

This application is a § 371 National Stage Application of PCT/FR2011/000637, filed Dec. 6, 2011, which claims priority to French Application No. 10/04865, filed Dec. 14, 2010.

BACKGROUND OF THE INVENTION

FIELD OF THE INVENTION

The present invention in general relates to aluminum alloy products and, more particularly, such thick products made of alloy 7xxx, their use and manufacturing processes.

DESCRIPTION OF RELATED ART

In the field of plastics obtained by injection-molding, there is a growing demand for large products. In order to produce molds to manufacture such large products, it is necessary to use thick blocks, i.e. blocks whose thickness is greater than 350 mm, and preferably greater than 450 mm or even greater than 550 mm. "Block" is taken to mean a solid product of essentially parallelepiped shape.

Thick aluminum blocks are also useful in the field of mechanical engineering.

The sought-after characteristics for thick aluminum blocks for the manufacture of molds are high static mechanical properties such as yield strength or ultimate tensile strength, and a high notch strength, these properties being in general antagonistic. Notch strength is an important property for the use of these products and may be characterized for example by the NSR, which is the ratio between the yield strength and strength in the presence of a notch ("Sharp-Notch Strength-to-Yield Strength Ratio") measured according to standard ASTM E602. For thick products, these properties should in particular be obtained at quarter- and/or mid-thickness and must therefore have low quench sensitivity. It is said that a product is quench sensitive if its static mechanical properties, such as yield strength decreases as the cooling rate decreases. The quenching speed is the average cooling rate of the product during the quench.

Thick blocks should also preferably have low residual stresses. Indeed, the residual stresses cause deformations during machining, which affect the geometry of the mold. Residual stresses can he measured for example by the method described in patent application WO 2004/053180. Low residual stresses typically involve a value $W_{Tbar}$ less than 4 kJ/m$^3$, and in general of the order of 2 kJ/m$^3$.

Finally, thick blocks must be obtained by means of a process that is as quick and as economical as possible.

Patent EP1587965 (Alcan) discloses an alloy useful for the manufacture of thick blocks, composed (as a percentage by weight) as follows: 4.6-5.2% Zn; 2.6-3.0% Mg; 0.1-0.2% Cu;

0.05-0.2% Zr; no more than 0.05% Mn; no more than 0.05% Cr; no more than 0.15% Fe; no more than 0.15% Si; no more than 0.10% Ti and a method of manufacturing these blocks, wherein the ingot directly obtained by continuous casting is used as the block.

International application WO 2008/005852 (Alcan) describes an alloy useful for very thick products including (as a percentage by weight) 6 to 8% zinc, 1 to 2% magnesium, dispersoid-forming elements such as Zr, Mn, Cr, Ti and/or Sc.

Alloys of similar composition are also known for other applications. The following are, for example, registered with the Aluminium Association:

alloy 7003 which has the following composition:
5.0-6 6.5% Zn; 0.50-1.0% Mg; 0.05-0.25% Zr; 0-0.20% Cu; 0-0.35% Fe; 0-0.30% Si; 0-0.30% Mn; 0-020% Cr; 0-0.20% Ti; the rest Al with unavoidable impurities <0.05%, total <0.15% alloy 7021 which has the following composition:
5.0%-6.0% Zn; 1.2-1.8% Mg; 0.08-0.18% Zr; 0-0.25% Cu; 0-0.40 9$^1$0 Fe; 0-0.25% Si; 0-0.10% Mn; 0-0.05% Cr; 0-0.10% Ti; the rest Al with unavoidable impurities <0.05%, total <0.15%

U.S. Pat. No. 3,852,122 (Ardal) discloses an alloy of composition (as a percentage by weight) 4.5-5.8%) Zn, 1.0 to 1.8% Mg, 0.10 to 0.30% Zr, 0 to 0.30% Fe, 0 to 0.15% Si, 0-0.25% Mn for making long products used for the manufacture of bumpers, structural parts and also parts used in the manufacture, storage and transport of gases in condensed state.

The patent application FR 2341661 (VMRBA) discloses an alloy of composition (as a percentage by weight) 4.0 to 6.2% Zn, 0.8-3.0% Mg, 0-1.5% Cu, 0.05 to 0.30% Zr, 0 to 0.20% Fe, 0 to 0.15% Si, 0 to 0.25% Mn, 0 to 0.10% Ti to be forged or kneaded by hot working and for use in the construction of vehicles, machines, tanks for appliances and tools.

Patent application JP81144031 (Furukawa) discloses an alloy of composition (as a percentage by weight) 4.0-6.5 Zn, 0.4-1.8% Mg, 0.1-0.5 Cu, 0.1-0.5% Zr, and additionally 0.05-0.20% Mn and/or Cr 0.05-0.20%, for the production of tubes.

The problem to be solved by the present invention is to obtain thick aluminum blocks with an improved balance of properties between static mechanical properties and notch strength, with a low level of residual stresses, by means of a rapid and economical process.

SUMMARY

A first object of the invention is an aluminum alloy for the manufacture of thick blocks comprising (as a percentage by weight):

Zn: 5.3-5.9%,
Mg: 0.8-1.8%,
Cu: <0.2%,
Zr: 0.05-0.12%,
Ti<0.15%,
Mn<0.1%,
Cr<0.1%,
Si<0.15%,
Fe<0.20% impurities with individual content <0.05% each and <0.15% of the total, the remainder being aluminum.

A second object of the invention is a method comprising the steps of:

(a) casting a thick block of an alloy according to the invention, (b) optionally homogenizing at a temperature of between 450 and 550° C. for a period of 10 minutes to 30 hours and/or stress-relieving at a temperature of between 300 and 400° C. for a period of 10 minutes to 30 hours followed by cooling to a temperature below 100° C.;

(c) solution heat treatment of said cast block at a temperature of 500 to 560° C. for 10 minutes to 20 hours, (d) cooling said solution heat treated block to a temperature below 100° C., (e) tempering said solution heat treated and cooled block by heating to 120 to 170° C. for 4 to 48 hours, wherein said block is not subjected to any significant deformation by working between the casting and the tempering.

Yet another object of the invention is a thick block of aluminum obtainable by the process according to the invention characterized in that at ¼ thickness in direction TL, the yield strength $R_{P0.2}$ and the ratio called NSR between the mechanical strength on a notched test-piece and the yield strength $R_{P0.2}$ measured according to ASTM E602-03, section 9.2 are such to that:

NSR>−0.017*$R_{p0.2}$6.7 and $R_{p0.2}$>320 MPa, preferably 330 MPa and/or:

NSR >0.8, preferably 1.0

Yet another object of the invention is the use of a thick block according to invention for the manufacture of molds for plastics injection-molding.

BRIEF DESCRIPTION OF THE DRAWING

FIG. 1: Compromise reached between the yield strength $R_{P0.2}$ and the parameter called NSR ("Sharp-Notch Strength-to-Yield Strength Ratio"), which is the ratio between the mechanical strength on a notched test-piece and the yield strength $R_{P0.2}$.

DETAILED DESCRIPTION OF A PREFERRED EMBODIMENT

Unless otherwise stated, all the indications concerning the chemical composition of the alloys are expressed as a percentage by weight based on the total weight of the alloy. The designation of alloys is compliant with the rules of The Aluminum Association (AA), known to experts in the field. The definitions of the tempers are indicated in European standard EN 515.

Unless otherwise stated, the static mechanical properties, in other words, the ultimate elongation at rupture $R_m$, the tensile yield strength $R_{p0.2}$ and elongation at rupture A, are determined by a tensile test according to EN 10002-1 or NF EN ISO 6892-1, the location at which the parts are held and their direction being defined by standard EN 485-1. The mechanical strength on a notched test-piece is obtained in accordance with standard ASTM E602-03. According to standard E602-03, section 9.2, the ratio called NSR between the mechanical strength on a notched test-piece and the yield strength $R_{P0.2}$ ("Sharp-Notch Strength-to-Yield Strength Ratio") is calculated, and this ratio gives an indication of the notch strength of the sample.

The problem is solved by an alloy comprising (as a percentage by weight);

Zn: 5.3-5.9%,

Mg: 0.8-1.8%,

Cu: <0.2%

Zr: 0.05-0.12%,

Ti<0.15%,

Mn<0.1%,

Cr<0.1%,

Si<0.15%,

Fe<0.20% impurities with individual content <0.05% each and <0.15% of the total, the rest aluminum.

The combination of the zinc content of 5.3 to 5.9% by weight, the magnesium content of 0.8 to 1.8% and the copper content less than 0.2% by weight makes it possible to achieve an improved compromise between mechanical resistance and notch strength. The preferred Zn content is 5.4 to 5.8% by weight. The preferred magnesium content is 1.0 to 1.4% by weight or even 1.1 to 1.3% by weight. The copper content is preferably less than 0.05% by weight or even less than 0.04% by weight.

The zirconium content is 0.05 to 0.12% by weight. Preferably, the zirconium content is at the most 0.10% by weight or even 0.08% by weight, particularly to further reduce the quench sensitivity of the thick aluminum blocks.

The titanium content is less than 0.15% by weight. Advantageously, a quantity of titanium of between 0.01 and 0.05% by weight and preferably between 0.02 and 0.04% by weight is added in order to refine the grain size during casting, The Cr content and the Mn content are less than 0.1%. Preferably, the Cr content is less than 0.05% by weight or even less than 0.03 by weight, and/or the Mn content is less than 0.05% by weight or even less than 0.03% by weight, which makes it possible to further reduce the quench sensitivity of the thick aluminum blocks.

Si and Fe are unavoidable impurities, the content of which is attempted to minimize, in particular to improve the mechanical strength on a notched bar. The Fe content is lower than 0.20% by weight and preferably lower than 0.15% by weight. The Si content is lower than to 0.15% by weight and preferably lower than 0.10% by weight.

A suitable method for making thick alloy blocks according to the invention comprises the steps of (a) casting a thick block of an alloy according to the invention, (b) solution heat treating said cast block at a temperature of 500 to 560° C. for 10 minutes to 20 hours, (c) cooling said solution heat treated block to a temperature below 100° C., (d) tempering said solution heat treated and cooled. block by heating to 120 to 170° C. for 4 to 48 hours.

The thick block is preferably cast by semi-continuous direct chill casting. The thick block has a thickness which is greater than 350 mm, and preferably greater than 450 mm or even greater than 550 mm. The block is substantially parallelepiped in shape: it generally has a largest dimension (length), a second largest dimension (width) and a smaller dimension (thickness).

The block may be optionally homogenized, typically by heat treatment at a temperature of between 450 and 550° C. for a period of 10 minutes to 30 hours and/or stress-relieved at a temperature of between 300 and 400° C. for a period of 10 minutes to 30 hours followed by cooling to a temperature below 100° C.;

The block then undergoes solution heat treatment, i.e. it is heat-treated so that the block temperature reaches 500-560° C. for a time between 10 minutes and 5 hours or even 20 hours. This heat treatment may be performed at a constant temperature or in several steps.

After solution heat treatment, the block is cooled to a temperature below 100° C., preferably to room temperature. Cooling can be performed in still air, with ventilated air, by spraying a mist, by spraying or by immersion in water. Advantageously, the cooling rate is at least 200° C./h.

In a first advantageous embodiment of the invention, the cooling rate is less than 200° C./h. In this embodiment, the residual stresses are low, but the mechanical properties do not reach their maximum values because of some quench sensitivity of the alloy, This cooling rate can be obtained in still air or with a fan.

In a second advantageous embodiment of the invention, the cooling rate is at least equal to 800° C./h. Such a cooling rate can be obtained by sprinkling or immersing in water. Since too high a cooling rate may generate too great residual stresses in the blocks, water at a temperature of at least 50° C. and preferably at least 70° C. is preferably used for cooling. In this second embodiment the quenched block is stress-relieved, preferably by cold compression with a permanent set of between 1% and 5% and preferably between 2 and 4%. Stress-relieving makes it possible to decrease the residual stresses in the metal and to avoid warpage during machining.

In a third advantageous embodiment of the invention, the cooling rate ranges between 200° C./h and 400° C./h. Surprisingly, when the cooling rate lies between 200° C./h and 400° C./h, satisfactory mechanical characteristics and low residual energy can simultaneously obtained making it possible to do away with the stage of stress-relieving by compression. Such a cooling speed can be obtained by fine spraying.

Finally, the solution heat treated and cooled block is tempered. Tempering is performed so that the block reaches a temperature of 120 to 170° C. and preferably between 130 and 160° C. for a period of 4 to 48 hours and preferably between 8 and 24 hours. Advantageously, tempering is performed to reach temper T6 or T652, corresponding to the peak of the static mechanical properties ($R_m$ and $R_{p0.2}$).

Between each operation, it is possible to perform simple operations of sawing the block and/or machining its surfaces.

However, said block is not subjected to any significant deformation by working between casting and tempering. "Working" is typically taken to mean hot rolling or forging operations.

"Significant deformation" means that none of the dimensions of the cast block—which is a thick block, substantially parallelepiped in shape (length L, width TL, thickness TC)—undergoes significant change, i.e. typically of at least about 10%, by working between the casting and the tempering. In other words, none of the dimensions of the cast block undergoes a relative change as a result of working of typically more than 10% as an absolute value, which means that said working causes no permanent deformation in each direction L, TL, TC greater than a value close to Ln(1.1) =0.095 and corresponds to a generalized plastic deformation $$\left(\bar{\varepsilon} = \sqrt{\frac{2}{3}(\varepsilon_L^2 + \varepsilon_{TL}^2 + \varepsilon_{TC}^2)}\right)$$

typically less than 0.135.

The thick blocks obtained by the method according to the invention have an advantageous compromise of properties, in particular between the yield strength and notch strength which are two antagonistic properties (the higher the one, the lower the other). More specifically, the applicant found that for a thick block of an alloy having the composition according to the invention, obtained by following the steps claimed in the process as far as the tempering stage (casting, optional homogenization and stress-relieving, solution hardening and quenching without any significant working between casting and the final tempering stage), regardless of the tempering treatment (single or multi-stage) then performed to achieve a given yield strength $R_{p0.2}$, the NSR ("Sharp-Notch Strength-to-Yield Strength Ratio"), i;e. the parameter used to characterize the notch strength of the block thus obtained, reaches a value which does not depend on the annealing treatment performed to obtain the targeted Rp02. We can therefore establish for such thick blocks a relationship between the measured Rp02 and NSR e.g. at ¼ thickness, and this relationship appears to be substantially linear.

The applicant has therefore been able to establish that, when the method of the first embodiment is used, notch strength as assessed at ¼ thickness in direction TL by the NSR (the ratio measured according to ASTM E602-03, section 9.2) is greater than:

$$-0.017*R_{p0.2}+6.4.$$

Typically, the NSR is at least 0.7, preferably 0.8 and the yield strength is at least 320 MPa, preferably 330 MPa.

When the method of the second embodiment is used, notch strength as assessed at ¼ thickness in direction TL by the NSR (the ratio measured according to ASTM E602-03, section 9.2) is greater than:

9—IR7645 GB $$-0.017*R_{p0.2}+6.7.$$

Typically, the NSR is at least 0.8, preferably 1.0 and the yield strength is at least 320 MPa, preferably 330 MPa.

Simultaneously obtaining high mechanical strength and high notch strength is a surprising result.

The thick blocks of the invention are advantageously used. to manufacture molds for injection-molding plastics.

The examples of the invention are referred to as A and B. Examples C, and D are presented for purposes of comparison. The chemical compositions of the various alloys tested in this example are given in table 1.

TABLE 1

| Chemical composition (% by weight) | | | | | | | | | |
|---|---|---|---|---|---|---|---|---|---|
| Reference | Si | Fe | Cu | Mn | Mg | Zn | Zr | Cr | Ti |
| A | 0.05 | 0.08 | 0.02 | 0.01 | 1.2 | 5.7 | 0.08 | <0.01 | 0.04 |
| B | 0.05 | 0.08 | 0.03 | <0.01 | 1.2 | 5.6 | 0.08 | <0.01 | 0.04 |
| C | 0.05 | 0.13 | 0.2 | 0.01 | 2.8 | 4.9 | 0.09 | <0.01 | 0.03 |
| D | 0.08 | 0.04 | 0.6 | <0.01 | 2.2 | 6.3 | 0.10 | <0.01 | 0.03 |

Alloys A, B, C and D were cast in the form of blocks of thickness 625 mm.

Alloy blocks A and C were processed as follows: the blocks were first homogenized for 10 h at 480° C. The blocks were then solution heat treated for 4 hours at 540° C. and air cooled to about 40° C./h (from 540° C. to 410° C. in 2 hours and then from 410° C. to 90° C. in 9 hours). The blocks were then subjected to tempering, first at 105° C. for about 12 hours and then at 160° C. for about 16 h.

Alloy blocks B and D were processed as follows: the blocks first underwent stress-relieving for 2 hours at 350° C. After solution heat treatment for 4 h at 540° C. (block B) or 10 h at 475° C. (block D), the blocks were cooled with water at 80° C. by immersion. The blocks were then subjected to stress relieving by compression of 3%. The alloy B blocks were then subjected to tempering of 130° C. for 24 h (block B1) or 150° C. for 16 h (block B2). The alloy D block meanwhile underwent tempering treatment first at 90° C. for 8-12 h and then at 160° C. for 14-16 h.

The mechanical properties obtained, measured at ¼ thickness in the direction TL are presented in Table 2

TABLE 2

Mechanical properties obtained at ¼ thickness in the TL direction

| Reference | Tempering | Rm (MPa) | Rp0.2 (MPa) | A50 (%) | NSR |
|---|---|---|---|---|---|
| A | 105° C. 10-15 h + 160° C. 16-17 h | 355 | 332 | 1.8 | 0.88 |
| B1 | T°1 (130° C./24 h) | 407 | 359 | 3 | 0.7 |
| B2 | T°2 (150° C./16 h) | 376 | 324 | 8 | 1.3 |
| C | 105° C. 10-15 h + 160° C. 16-17 h | 335 | 320 | 0.4 | 0.50 |
| D | 90° C. 8-12 h + 160° C. 14-16 h | 401 | 335 | 2 | 0.87 |

FIG. 1 shows the compromise obtained between the yield strength $R_{P0.2}$ and the ratio called "Sharp-Notch Strength-to-Yield Strength Ratio", known by the abbreviation "NSR" and commonly used to characterize the sensitivity of the notch strength of a material. As its full name implies, this parameter is the ratio of the mechanical strength measured on a notched test-piece and the yield strength measured on an unnotched test-piece. The justification for the use of this parameter and the experimental protocol to measure it are described in standard ASTM E602-03, in particular in section 9.2.

Under identical transformation conditions, alloy A according to the invention provides, when compared to alloy C, a simultaneous improvement in the yield strength and the NSR ratio, and therefore in notch strength. The NSR ratio obtained is greater than $-0.017*R_{p0.2}+6.4$.

The preferred transformation process of the alloy according to the invention can further improve the NSR ratio. The block B alloy of the invention achieved an NSR ratio greater than $-0.017*R_{p0.2}+6.7$.

This ratio is not attained by alloy D in similar transformation conditions.

The invention claimed is:

1. A method of manufacturing a thick block of aluminum comprising:

(a) casting a rough alloy shape comprising an aluminum alloy comprising (as a percentage by weight)

Zn: 5.7-5.8%,
Mg: 0.8-1.8%,
Cu: <0.05%,
Zr: 0.08-0.12%,
Ti: <0.15%,
Mn: <0.1%,
Cr: <0.1%,
Si: <0.15%,
Fe: <0.20%,
impurities with individual content <0.05% each and <0.15% of the total, rest aluminum, (c) solution heat treating said cast block at a temperature of from 500 to 560° C. for 10 minutes to 20 hours, (d) cooling said solution heat treated block to a temperature of not more than 100° C. in still air or with a fan, the cooling rate being less than 200° C/h, (e) tempering said solution heat treated and cooled block by heating to from 120 to 170° C. for 4 to 48 hours, wherein said block is not subjected to any significant deformation by working between the casting and the tempering, and wherein said block has a thickness greater than 350 mm, and wherein the manufactured thick block of aluminum exhibits at ¼ thickness in direction TL, yield strength RP0.2 and a ratio called NSR between the mechanical strength on a notched bar and the yield strength RP0.2 measured according to ASTM E602-03, the following properties:

NSR>−0.017*Rp0.2+6.4 and

Rp0.2>330 MPa.

2. The method according to claim 1, wherein the aluminum ahoy comprises (as a percentage by weight):

Mg: 1.0-1.4%.

3. The method according to claim 1, wherein the aluminum alloy comprises a Zr: 0.08-0.10% by weight.

4. The method according to claim 1, wherein the aluminum alloy comprises one or more of (as a percentage by weight):

Ti: 0.01-0.05%,
Mn: <0.05%,
Cr: <0.05%,
Si: <0.10%, and
Fe: <0.15%.

5. The method according to claim 1, wherein the manufactured thick aluminium block exhibits an NSR>0.8.

6. The method according to claim 1, wherein the manufactured thick aluminum block is capable of being used for manufacturing molds for injection-molding plastics.

7. The method according to claim 1, further comprising:

(b) homogenizing at a temperature of from 450 to 550° C. for a period of from 10 minutes to 30 hours and/or stress-relieving at a temperature of from 300 to 400° C. for a period of from 10 minutes to 30 hours followed by cooling to a temperature of not more than 100° C.

8. The method according to claim 1, wherein the tempering of (e) is carried out by heating said solution heat treated and cooled block to from 130 to 160° C. for 8 to 24 hours.

9. The method according to claim 1, wherein the tempering of (e) is performed to reach temper T6 or T652, corresponding to a peak of static mechanical properties ($R_m$ and $R_{p0.2}$).

10. The method according to claim 1, wherein the aluminum alloy comprises (as a percentage by weight) about 5.7% Zn.

11. The method according to claim 1, wherein said block has a thickness greater than 450 mm.

12. The method according to claim 1, wherein said block has a thickness greater than 550 mm.

* * * * *